US006435120B2

(12) United States Patent
Duncan

(10) Patent No.: US 6,435,120 B2
(45) Date of Patent: Aug. 20, 2002

(54) THRUSTER

(75) Inventor: Ian James Duncan, Bathgate (GB)

(73) Assignee: Lewmar Limited, Hampshire (GB)

( * ) Notice: Subject to any disclaimer, the term of this patent is extended or adjusted under 35 U.S.C. 154(b) by 0 days.

(21) Appl. No.: 09/828,887

(22) Filed: Apr. 10, 2001

(30) Foreign Application Priority Data

Apr. 10, 2000 (GB) ..... 0008763

(51) Int. Cl.[7] ..... B63H 25/46
(52) U.S. Cl. ..... 114/151
(58) Field of Search ..... 440/38, 47; 114/151

(56) References Cited

U.S. PATENT DOCUMENTS 3,127,865 A * 4/1964 Pleuger ..... 114/151
4,074,652 A * 2/1978 Jackson ..... 114/151
4,214,544 A 7/1980 Dashew et al.
4,455,960 A 6/1984 Aker
4,629,432 A * 12/1986 Dyrkorn et al. ..... 114/151

FOREIGN PATENT DOCUMENTS

| | | | |
|---|---|---|---|
| EP | 0 037 865 | 10/1981 | |
| GB | 1419546 | * 12/1975 | ..... 114/151 |
| GB | 2 337 240 | 11/1999 | |

* cited by examiner

*Primary Examiner*—Ed Swinehart
(74) *Attorney, Agent, or Firm*—Burns, Doane, Swecker & Mathis, L.L.P.

(57) ABSTRACT

A thruster is adapted to be laterally mounted through the hull of the vessel and has propulsive ducts for opening to respective sides of the vessel and an inlet to the inboard end of both of the ducts, the inlet being at least partially provided by a tunnel having an internal cross-sectional area greater than that of the ducts, the tunnel at least partially surrounding each of the ducts and opening to each side of the vessel.

12 Claims, 2 Drawing Sheets

THRUSTER

This invention relates to thrusters, which are systems for the lateral propulsion of waterborne vessels. We are concerned with such thrusters that are permanently installed in the vessel (whether as original equipment or post-fitted) and which may be found at the bow or the stern of the vessel, most usually at the bow.

Such thrusters are very well-known and for the most part can be regarded as a ducted fan of which the propulsive duct is mounted transversely through the hull of the vessel so as to open into water at each side of it. There may be a single or a double pump rotor in the duct and it or they may be reversible.

However, as far as we are aware, all such thrusters have penetrated the hull only by the duct containing the pump rotor, and have been constructed in the usual way for a ducted fan, namely with the rotor occupying as far as practicable the complete cross-sectional area of the duct.

In contrast, according to the present invention a thruster for mounting laterally through the hull of a waterborne vessel has propulsive ducts for opening to respective sides of the vessel and an inlet to the inboard end of both of the ducts, the inlet, being at least partially be provided by a tunnel which at least partially surrounds each of the ducts and like them is for opening to each side of the vessel, the tunnel having an internal cross-sectional area greater than that of the ducts.

An axial or mixed flow pump rotor is mounted in each of the ducts and arranged for driving in respectively opposite lateral directions. Preferably drive to both of the rotors comes from a single prime mover to respective unidirectional drives arranged coaxially with the rotors. The prime mover is preferably reversible. Inboard inlets to the propulsive ducts are preferably arranged symmetrically about the drive to the unidirectional drives.

The propulsive ducts may be entirely contained is within the tunnel and may be coaxial with a cylindrical such tunnel or be off centre of it. The tunnel need not necessarily be circular in outline in its internal cross-section; its outboard ends may be faired to conform to where it penetrates the vessel hull.

A preferred prime mover is a reversible electric motor and a preferred transmission format is a synchronous driving belt which drives one or other of the pump rotors by means of unidirectional roller clutches.

The invention includes a waterborne vessel equipped with such a thruster.

Figure 1:
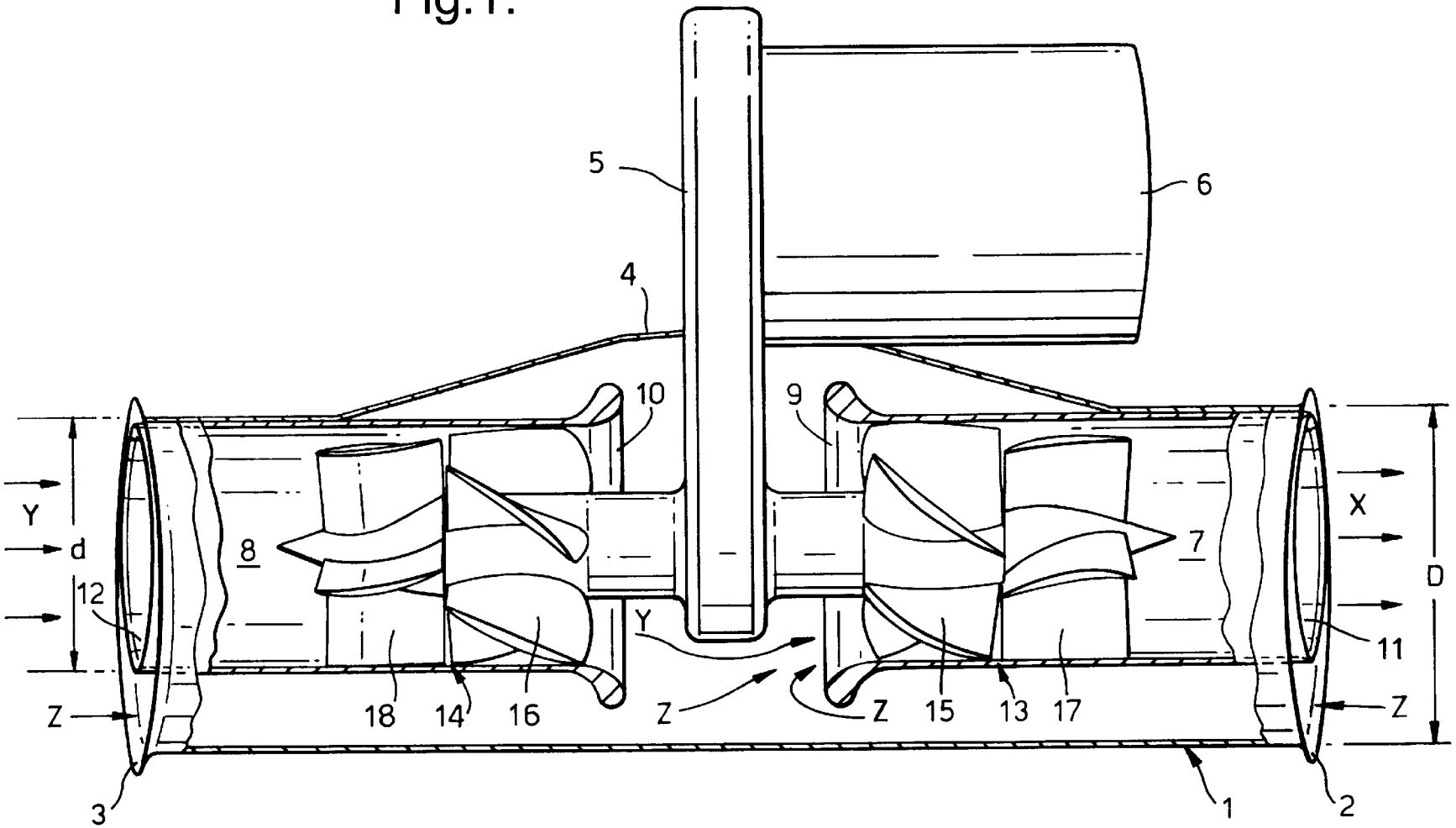
Figure 2:
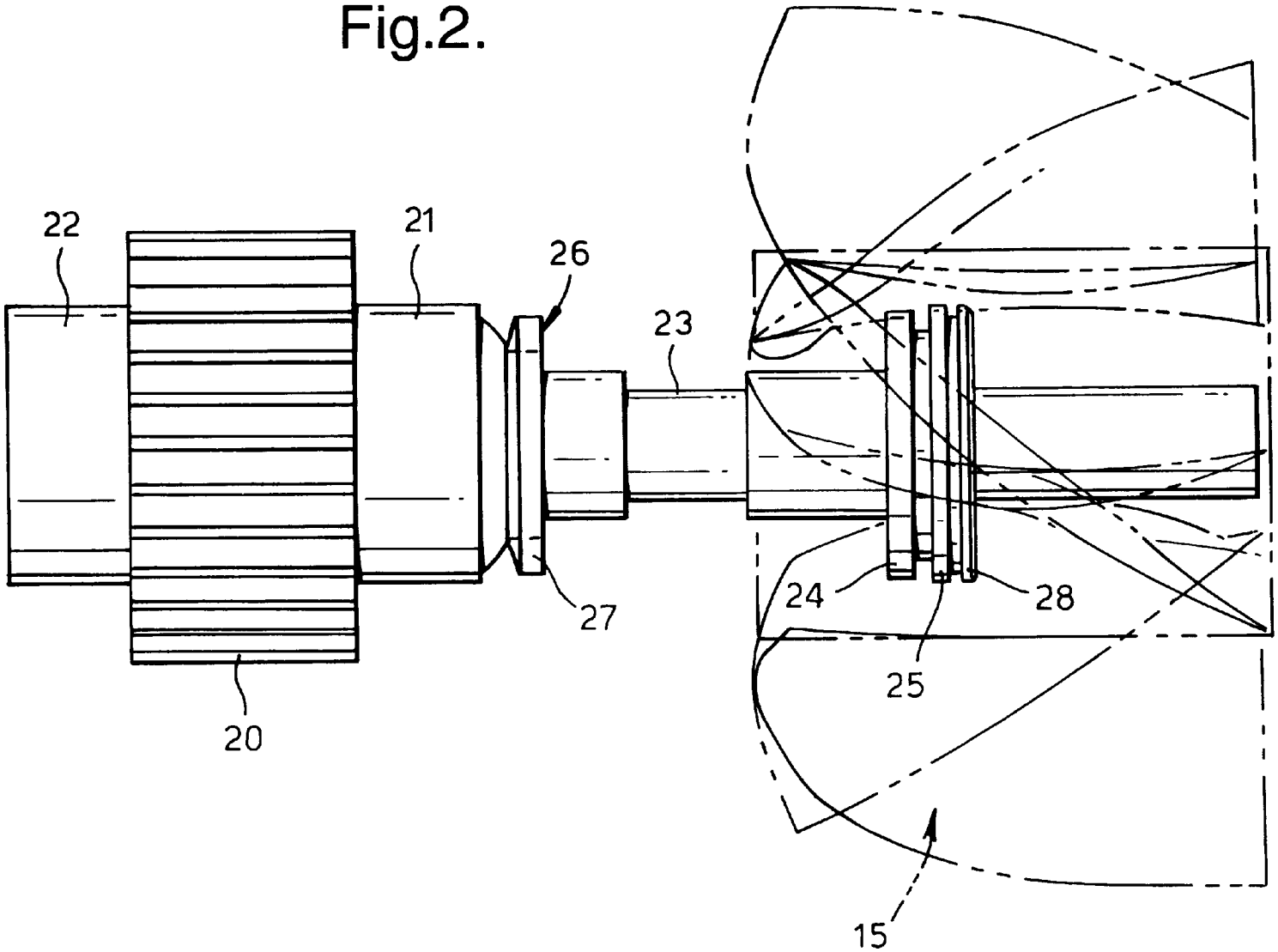

A particular embodiment of the invention will now be described with reference to the accompanying drawings, wherein FIG. 1 is a cutaway view of the embodiment; and FIG. 2 shows detail of construction of a propeller drive.

Looking first at FIG. 1, a tunnel 1 of diameter D is for positioning laterally through the hull of a waterborne vessel so that its ends 2,3 are respectively open to the water at the lateral sides of the vessel.

The ends 2 and 3 of the tunnel wall are flared or otherwise shaped so as to be faired to the hull so as to reduce water resistance and inlet losses when the vessel is proceeding normally.

Alternatively, ends of the tunnel may be separate mouldings, adapted for a particular vessel or type of vessel and to be joined to a plain tunnel upon installation. As will become evident, the tunnel need not be of circular cross-section but can be any convenient shape conformable to the structure of the vessel, and in particular of its bulkheads, to which it is fitted or to be fitted.

At its central portion the tunnel is flared outwardly at 4 to provide lateral support for a casing and to provide increased flow area.

This casing 5 has at one end a housing 6 for a reversible electric motor and at the other surrounds a drive assembly for the thruster.

The thruster has two cylindrical propulsion ducts 7 and 8 which are of diameter d, which have inboard ends 9,10 disposed laterally symmetrically on each side of the casing 5, and outboard ends 11,12 which are sharp edged and lie just within ends 2 and 3 of the tunnel.

Propulsion within the ducts is provided by respective propeller assemblies 13,14 which are to drive in the respective outboard direction by means of an inboard rotor 15,16 acting with an outboard stator 17,18.

The drive structure is seen in more detail in FIG. 2, where a toothed pulley 20 driven by a synchronized belt from a like pulley on the drive shaft of the motor in the casing 6, the sychronized belt being contained within casing 5.

At each outboard side of the pulley 20 are unidirectional drives 21 and 22 which are roller clutches set to drive in opposite directions of rotation. Further details of construction are shown only in respect of one side of the assembly but are identical in mirror image on the other side. The unidirectional drive 21 drives a rotor shaft 23 on a hub 24 of which the propeller rotor 15 is mounted, thrust from the rotor being taken also on a needle roller thrust race 25.

A PTFE ring 27 takes any reverse thrust which may occur when the pump rotor 15 is idling and also locates the toothed pulley 20. The shaft 23 is sealed by means of twin radial seals 28 at its outboard end and by a V-seal 27 at its inboard end.

In operation, the motor is driven in a sense of rotation appropriate for transmission of drive either to rotor 15 or to rotor 16. Assuming rotor 15 to be driven, a jet of water will be propelled through duct 7 as shown by arrows X; rotor 16 will free-wheel in a partial inflow of water shown by arrows Y. However, there will also be inflow of water through the free area of the tunnel 1, as shown by arrows Z, and these flows will all be available as an inlet flow to the inboard end 9 of the tunnel 7. Hence, one has a propulsive column of water shown by arrows X of which the output velocity is greater than an input velocity of water whether contributed by arrows Y or arrows Z. In exactly the same way, if rotor 16 is driven lateral propulsion in the opposite direction will be assured by a propulsive jet of water of arrows Y (now reversed in direction) with input from arrows Z through the free area of the tunnel and through duct 7 by arrows X (now reversed).

The relationship between the cross-sectional areas of the propulsive ducts and of the tunnel is not critical. Furthermore, although FIG. 1 shows that the tunnel 1 and the ducts 7, 8 have respective central axes that are offset from one another, the axes of the ducts may alternatively be coaxial with the tunnel (not shown). Although increasing propulsive duct diameter would increase the efficiency of the rotors and reduce the power needed, an increase in tunnel cross-section would increase the space required. An example of diameter d for a 3 Kw, 50 Kgf thrust model would be 90 mm and of diameter D 130 mm. On the other hand, given that the propulsion duct diameters cannot for that reason be increased greatly the rotor and stator lengths should be as axial lengths should be as great as possible to reduce cavitation effects and for example as shown the dimension W from end to end of the two propellers is 330 mm with a lateral dimension A for the casing of 30 mm.

I claim:

1. A thruster for lateral propulsion of a waterborne vessel having a hull with two sides wherein said thruster is laterally mounted through said hull of said vessel, said thruster having propulsive ducts each having an inboard and an outboard end, propulsive means in said ducts between said inboard and outboard ends, said outboard end for opening to respective sides of said vessel, and an inlet to said inboard end of both of said ducts wherein said inlet is at least partially provided by a tunnel having an internal cross-sectional area greater than that of said ducts, said tunnel at least partially surrounds each of said ducts to provide a passage past the propulsive means, and said tunnel being for opening to each side of said vessel.

2. A thruster according to claim 1 wherein said ducts are entirely contained within said tunnel.

3. A thruster according to claim 1 wherein said tunnel is cylindrical.

4. A thruster according to claim 1, wherein said propulsive means include an axial or mixed flow pump rotor mounted in each of the propulsive ducts between the inboard and outboard ends thereof, said rotors arranged for driving in respectively opposite lateral directions.

5. A thruster according to claim 4 wherein drive to both the rotors comes from a single prime mover to respective unidirectional drives arranged coaxially with the rotors.

6. A thruster according to claim 5 further comprising a transmission, the transmission comprising a synchronous driving belt which drives one or other of the pump rotors by means of unidirectional roller clutches.

7. A thruster according to claim 5 wherein said prime mover is reversible.

8. A thruster according to claim 7 wherein said prime mover is a reversible electric motor.

9. A thruster according to claim 6 wherein said inlet to the inboard ends to the propulsive ducts are arranged symmetrically about the drive to the unidirectional drives.

10. A waterborne vessel including a thruster as defined in claim 1.

11. A thruster for lateral propulsion of a waterborne vessel having a hull with two sides wherein said thruster is to be laterally mounted through the hull of the vessel, said thruster having a tunnel for opening to each of the two sides of the hull and extending through the hull, laterally-extending ducts within the tunnel each containing propulsive means and having an outboard end and an inboard end, the inboard ends opening to a central zone of the tunnel, and a passage within the tunnel but outside each duct leading from an outboard end of the tunnel to said central zone for water flow therebetween.

12. A waterborne vessel having a hull with two sides with a thruster for lateral propulsion of the vessel, said thruster having a tunnel opening to each of the two sides of the hull and extending through the hull, laterally-extending ducts within the tunnel each containing propulsive means and having an outboard end and an inboard end, the inboard ends opening to a central zone of the tunnel, and a passage within the tunnel but outside each duct leading from an outboard end of the tunnel to said central zone for water flow therebetween.

* * * * *